US010609996B2

(12) United States Patent
Gregory

(10) Patent No.: US 10,609,996 B2
(45) Date of Patent: Apr. 7, 2020

(54) VACUUM ASSISTED STORAGE DEVICE

(71) Applicant: Kathryn Ann Gregory, Kokomo, IN (US)

(72) Inventor: Kathryn Ann Gregory, Kokomo, IN (US)

( * ) Notice: Subject to any disclaimer, the term of this patent is extended or adjusted under 35 U.S.C. 154(b) by 0 days.

(21) Appl. No.: 16/123,006

(22) Filed: Sep. 6, 2018

(65) Prior Publication Data

US 2019/0000203 A1 Jan. 3, 2019

Related U.S. Application Data

(63) Continuation-in-part of application No. 15/933,981, filed on Mar. 23, 2018.

(60) Provisional application No. 62/479,824, filed on Mar. 31, 2017.

(51) Int. Cl.

| | |
|---|---|
| ***A45C 13/02*** | (2006.01) |
| ***A45C 13/00*** | (2006.01) |
| ***A45C 7/00*** | (2006.01) |
| ***A45F 3/04*** | (2006.01) |

(52) U.S. Cl.

CPC ..... *A45C 13/02* (2013.01); *A45C 7/004* (2013.01); *A45C 7/0081* (2013.01); *A45C 13/008* (2013.01); *A45F 3/04* (2013.01); *A45C 2013/026* (2013.01); *A45C 2013/028* (2013.01)

(58) Field of Classification Search

CPC ..... A45C 5/03; A45C 7/00; A45C 7/0022; A45C 7/004; A45C 7/0081; A45C 13/00; A45C 13/008; A45C 13/02; A45C 13/021; A45C 2013/028; B65D 25/20; B65D 81/38; A45F 3/04

USPC ..... 206/524.8

See application file for complete search history.

(56) References Cited

U.S. PATENT DOCUMENTS

| | | | | |
|---|---|---|---|---|
| 6,135,253 | A * | 10/2000 | Weissman | A45C 13/02 190/110 |
| 6,499,574 | B1 * | 12/2002 | Anthony | A45C 13/008 190/102 |
| 8,251,192 | B1 * | 8/2012 | Milani | A45C 15/00 190/103 |
| 8,459,422 | B1 * | 6/2013 | Efron | A45C 13/02 190/109 |
| 9,706,823 | B2 * | 7/2017 | Efron | A45C 5/03 |

(Continued)

FOREIGN PATENT DOCUMENTS

| | | | | |
|---|---|---|---|---|
| TW | 200936074 | A * | 9/2009 | A45F 3/04 |

*Primary Examiner* — Bryon P Gehman

(74) *Attorney, Agent, or Firm* — Patentfile, LLC; Bradley C. Fach; Steven R. Kick

(57) ABSTRACT

A vacuum assisted storage device may include a body having a first wall and a second wall coupled to a base. A vacuum compartment may be bounded by the base, first wall, and second wall. A vacuum compartment fastener may be configured to govern access to the vacuum compartment by removably coupling portions of the first wall to the second wall. A vacuum container may be configured to be received within the vacuum compartment. The vacuum container may define a vacuum storage cavity. A vacuum cavity fastener may govern access to the vacuum storage cavity, and the vacuum cavity fastener may form a removably air tight seal that is configured to be sealed and unsealed. A vacuum pump may be in communication with the vacuum storage cavity, and the vacuum pump may be operable to pump air out of the vacuum storage cavity.

10 Claims, 10 Drawing Sheets

(56) References Cited

U.S. PATENT DOCUMENTS

| | | | | |
|---|---|---|---|---|
| 2011/0024475 | A1* | 2/2011 | Brungard | A45C 13/02<br>224/653 |
| 2011/0259693 | A1* | 10/2011 | Nascarella | A45C 7/0022<br>190/18 A |
| 2013/0048456 | A1* | 2/2013 | Govor | A45C 13/02<br>190/111 |
| 2018/0162626 | A1* | 6/2018 | Munie | B65D 25/18 |

* cited by examiner

VACUUM ASSISTED STORAGE DEVICE

CROSS REFERENCE TO RELATED APPLICATIONS

This application claims priority to and the benefit of the filing date of U.S. Non-Provisional application Ser. No. 15/933,981, filed on Mar. 23, 2018, entitled "VACUUM ASSISTED STORAGE DEVICE", which claims priority to and the benefit of U.S. Provisional Patent Application No. 62/479,824, filed on Mar. 31, 2017, entitled "VACUUM ASSISTED STORAGE DEVICE", the entire disclosures of which are incorporated by reference herein.

FIELD OF THE INVENTION

This patent specification relates to the field of devices that are configured to store and transport objects. More specifically, this patent specification relates to devices which are configured to receive objects and to store the objects in a compact size through assistance of a vacuum to facilitate transport of the device and objects.

BACKGROUND

Individuals frequently must transport objects from place to place. To facilitate the transport of multiple objects, they may be placed in portable storage devices such as backpacks, duffle bags, and travel bags, other bags, soft and hard suitcases, wheeled travel cases, and the like. These portable storage devices enable the user to easily move about while the portable storage devices contain and support the weight of the objects contained therein. However, no matter what size and shape these portable storage devices are configured in, they all have a limited interior space that they define. Each object that a user desires to position within that limited space occupies a volume. For this reason, the number of objects that conventional portable storage devices can accommodate is limited by the volume of the objects. If a user wishes to transport more objects, they must carry them by hand or use another storage device. Unfortunately, they may be left with no free hands and must let go of a storage device or object in order to interact with doors, cashiers, and the like. Additionally, for portable storage devices that are somewhat flexible, when filled to capacity these devices can become bulky and unwieldy.

Therefore, a need exists for novel devices that are configured to facilitate the storage and transport of objects. There is also a need for novel portable storage devices which are able to accommodate more objects than similar sized conventional portable storage devices. Finally, a need exists for novel portable storage devices which are able to store objects in a while remaining relatively compact and easy to maneuver.

BRIEF SUMMARY OF THE INVENTION

A vacuum assisted storage device is provided which is configured to facilitate the storage and transport of objects in a vacuum to reduce the size of the device and/or objects contained therein. In some embodiments, the device may include a body having a base, a first wall, and a second wall, and the first wall and second wall may be coupled to the base. A vacuum compartment may be bounded by the base, first wall, and second wall. A vacuum compartment fastener may be configured to govern access to the vacuum compartment by removably coupling portions of the first wall to the second wall. A vacuum container may be configured to be received within the vacuum compartment. The vacuum container may define a vacuum storage cavity, and the vacuum container may comprise an air impermeable material. A vacuum cavity fastener may govern access to the vacuum storage cavity, and the vacuum cavity fastener may form a removably air tight seal that is configured to be sealed and unsealed. A vacuum pump may be in communication with the vacuum storage cavity, and the vacuum pump may be operable to pump air out of the vacuum storage cavity, thereby decreasing the size of the vacuum storage cavity around one or more objects placed within.

In further embodiments, the device may include one or more other walls, such as a third wall and a fourth wall, which may be configured to form one or more storage compartments, such as a first storage compartment and a second storage compartment.

In further embodiments, the device may include a power source which may provide electrical power to the vacuum pump and optionally to a power coupling.

In still further embodiments, a user may operate one or more control inputs which may modulate electric power communication to the vacuum pump and to an optional power coupling.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Figure 1:
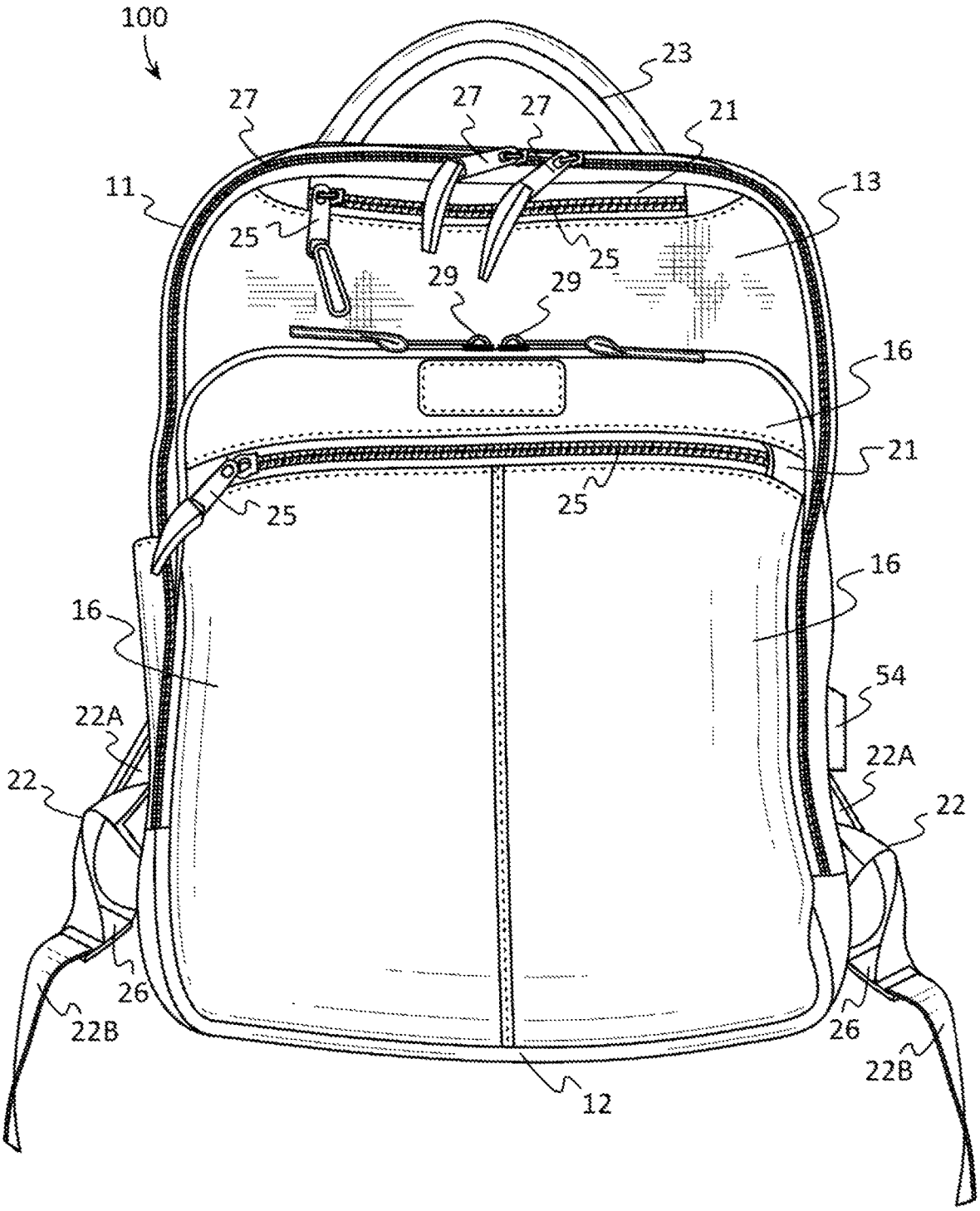
FIG. 1 depicts a front perspective view of an example of a vacuum assisted storage device according to various embodiments described herein.
Figure 2:
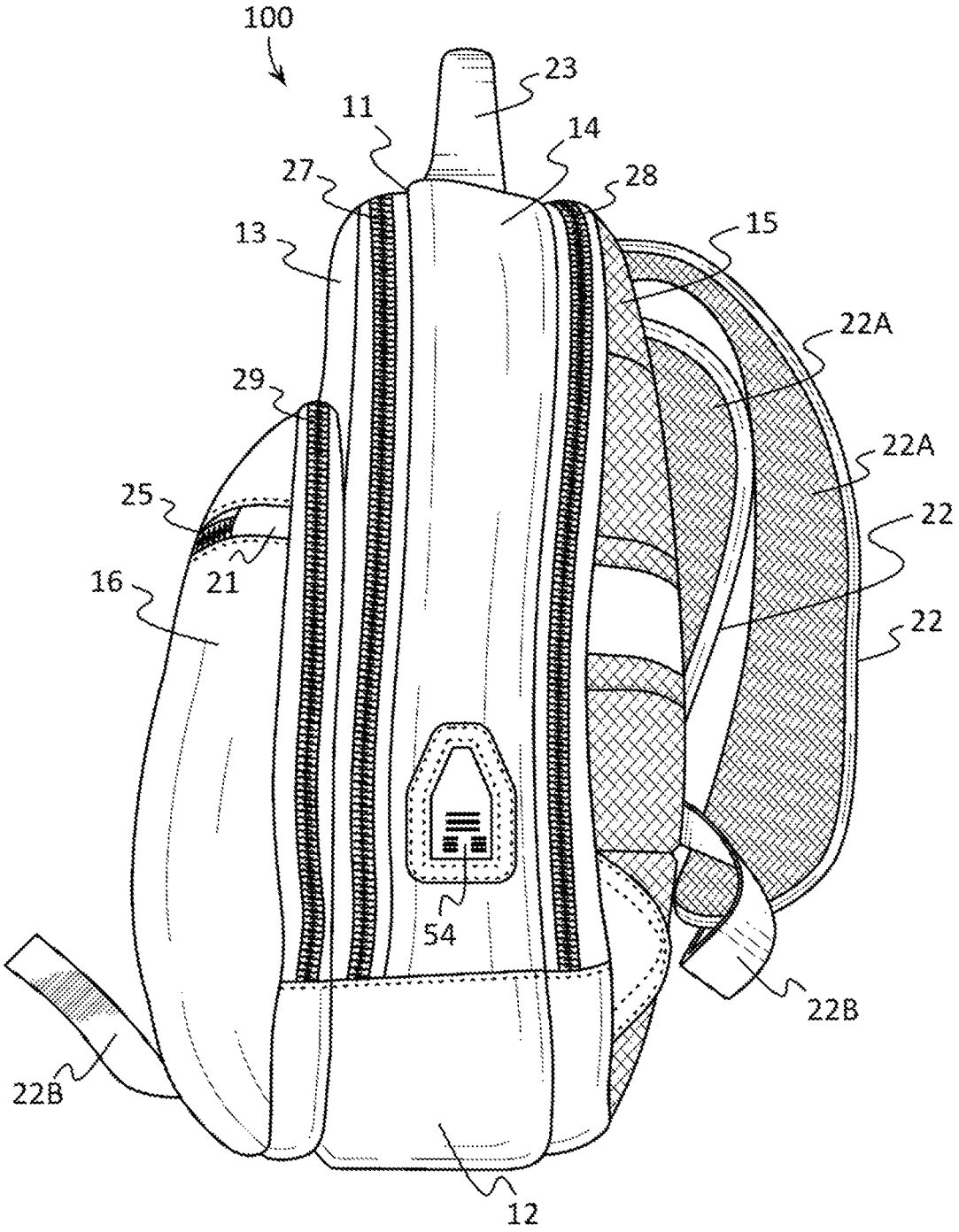
FIG. 2 illustrates a first side perspective view of an example of a vacuum assisted storage device according to various embodiments described herein.
Figure 3:
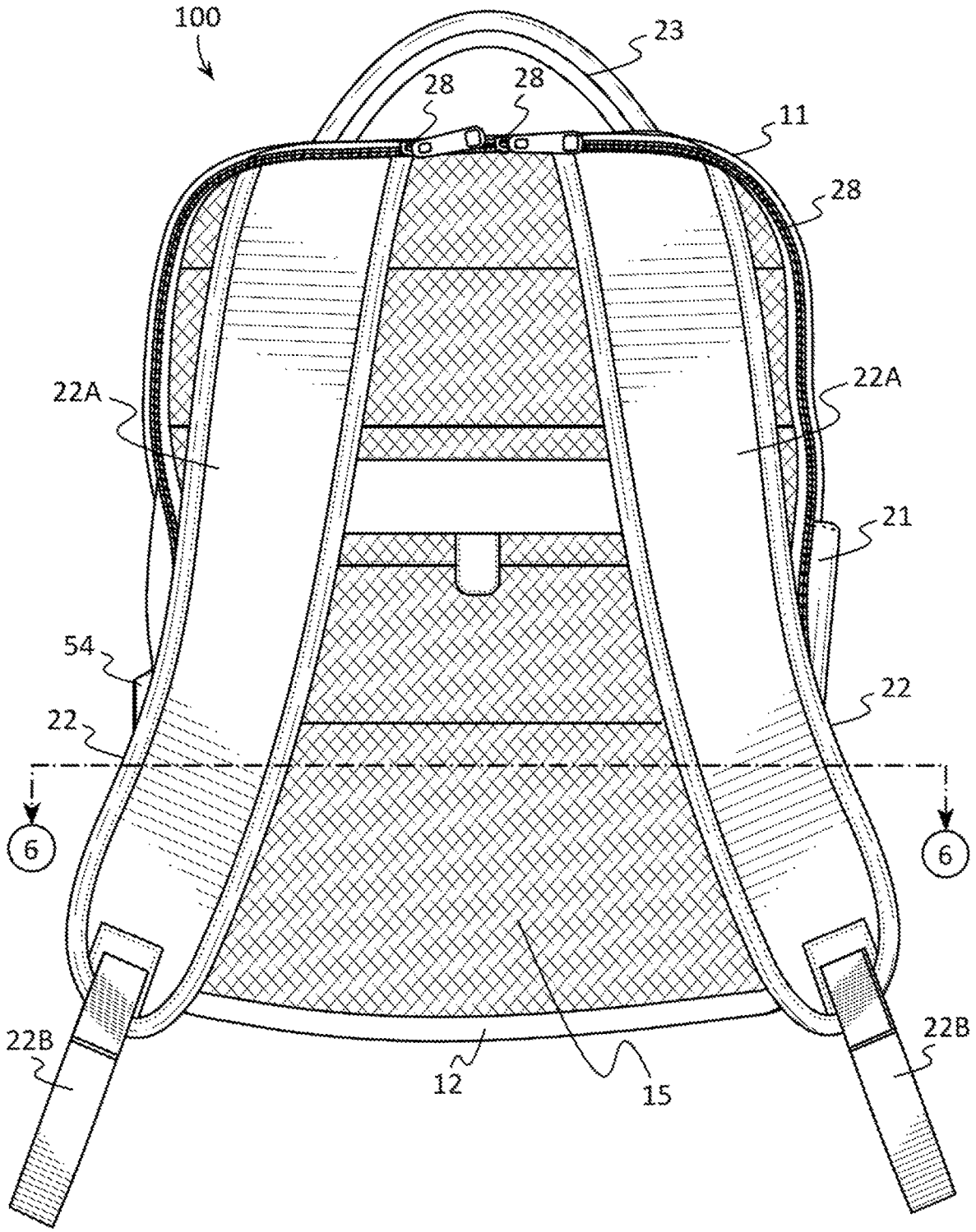
FIG. 3 shows a rear perspective view of an example of a vacuum assisted storage device according to various embodiments described herein.
Figure 4:
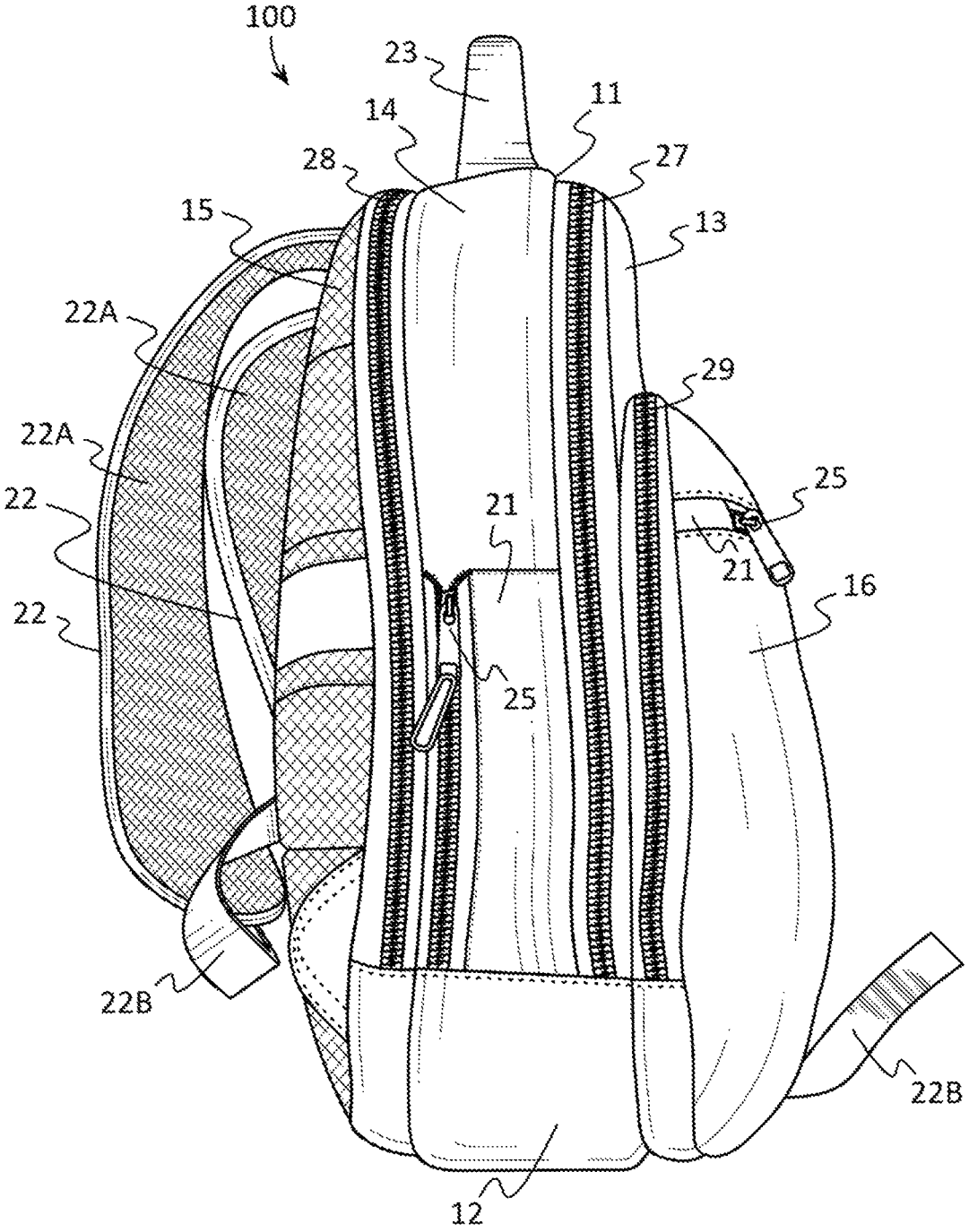
FIG. 4 depicts a second side perspective view of an example of a vacuum assisted storage device according to various embodiments described herein.
Figure 5:
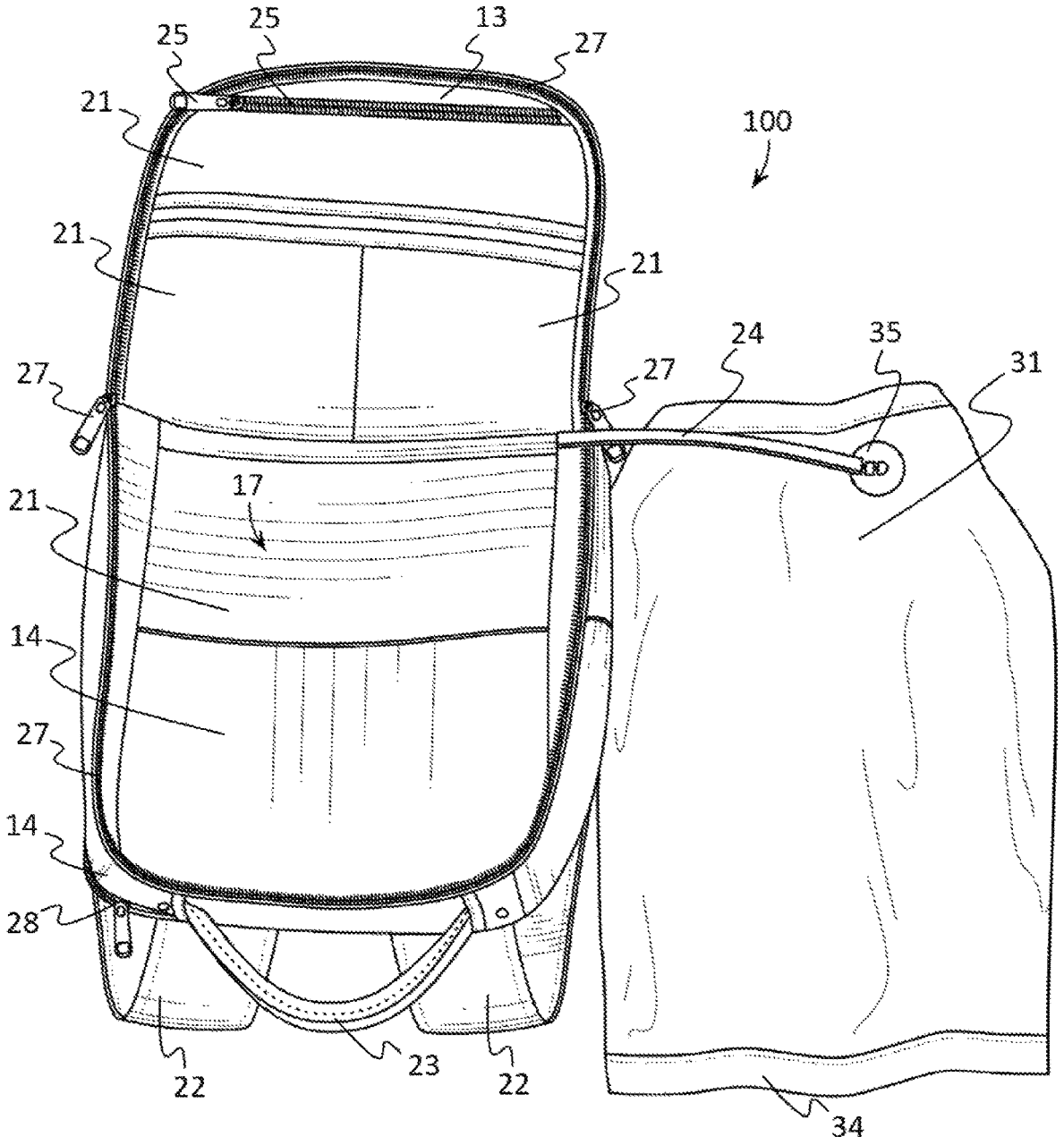
FIG. 5 illustrates a front perspective view of an example of a vacuum assisted storage device opened to show an example vacuum compartment and vacuum container according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

A new portable storage device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-13 illustrate examples of a vacuum assisted storage device ("the device") 100 according to various embodiments. In some embodiments, the device 100 may comprise a body 11 having a base 12, a first wall 13, and a second wall 14, and the first wall 13 and second wall 14 may be coupled to the base 12. A vacuum compartment 17 may be bounded by the base 12, first wall 13, and second wall 14. A vacuum compartment fastener 41 may be configured to govern access to the vacuum compartment 17 by removably coupling portions of the first wall 13 to the second wall 14. A vacuum container 31 may be configured to be received within the vacuum compartment 17. The vacuum container 31 may define a vacuum storage cavity 32, and the vacuum container 31 may comprise an air impermeable material 33. A vacuum cavity fastener 34 may govern access to the vacuum storage cavity 32, and the vacuum cavity fastener 34 may form a removably air tight seal that is configured to be sealed and unsealed. A vacuum pump 51 may be in communication with the vacuum storage cavity 32, and the vacuum pump 51 may be operable to pump air out of the vacuum storage cavity 32, thereby decreasing the size of the vacuum storage cavity 32 around one or more objects placed within. Optionally, the device 100 may comprise one or more other walls, such as a third wall 15 and a fourth wall 16, which may be configured to form one or more storage compartments, such as a first storage compartment 18 and a second storage compartment 19.

The body 11 may comprise a base 12 and one, two, three, four, five, six, seven, or more walls 13, 14, 15, 16, which may define one or more compartments 17, 18, 19, of the device 100. In preferred embodiments, the body 11 may comprise a first wall 13, second wall 14, third wall 15, and fourth wall 16. The walls 13, 14, 15, 16, may be configured in any size or shape thereby allowing the body 11 and one or more compartments 17, 18, 19, to be configured in any size or shape. A base 12 may perform structural functions similar to a wall 13, 14, 15, 16, while the base 12 may form the bottom or lower portions of the device 100. It should be understood that a base 12 may be formed by one or more portions of one or more walls 13, 14, 15, 16, which may be coupled together to form the bottom or lower portions of the device 100. Optionally, the device 100 may comprise a lid which may form the top or upper portions of the device 100. It should also be understood that a lid may be formed by one or more portions of one or more walls 13, 14, 15, 16, which may be coupled together to form the top or upper portions of the device 100.

In some embodiments, a wall 13, 14, 15, 16, may be configured in a generally rectangular shape, while in further embodiments a wall 13, 14, 15, 16, may be configured in curved or cylindrical shapes. However, it should be understood to one of ordinary skill in the art that the body 11, wall(s) 13, 14, 15, 16, compartments 17, 18, 19, and any other element discussed herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

In some embodiments, the body 11 and/or one or more walls 13, 14, 15, 16, may be made from or comprise a substantially rigid material. For example, the body 11 may comprise a base 12 which may be substantially rigid while the other walls 13, 14, 15, 16, may be generally flexible. In another example, the body 11 may comprise one or more walls 13, 14, 15, 16, which may be substantially rigid thereby allowing the body 11 to be configured as a hard sided case. A substantially rigid material may comprise steel alloys, aluminum, aluminum alloys, copper alloys, any other type of metal or metal alloy, any type of ceramic, various types of hard plastics, such as polyethylene (PE), polypropylene (PP) and polyvinyl chloride (PVC), polycarbonate, nylon, Poly(methyl methacrylate) (PMMA) also known as acrylic, melamine, hard rubbers, fiberglass, carbon fiber, resins, such as epoxy resin, wood, other plant based materials, or any other material including combinations of materials that are substantially rigid.

In some embodiments, the body 11 and/or one or more walls 13, 14, 15, 16, may be made from or comprise a substantially flexible material. For example, the body 11 may comprise a wall 13, 14, 15, 16, which may be substantially rigid while the other walls 13, 14, 15, 16, may be generally flexible. In another example, the body 11 may comprise one or more walls 13, 14, 15, 16, which may be substantially flexible thereby allowing the body 11 to be configured as a bag, pack, satchel, or other generally flexible object carrying device. A substantially flexible material may comprise various types of flexible plastics such as polyvinyl chloride, natural or synthetic rubber, synthetic fabrics such as polyester, acrylic, nylon, rayon, acetate, spandex, lastex, and Kevlar, and natural fabrics such as coir, cotton, hemp, jute, canvas, flax, leather, linen, ramie, wool, silk, or any other suitable flexible natural or synthetic material including combinations of materials.

The body 11 may include one or more vacuum containers 31. A vacuum container 31 may form or define a vacuum storage cavity 32 which may be sized and shaped to contain one or more objects. In some embodiments, a vacuum container 31 may be configured to be removably received within a compartment 17, 18, 19, such as the vacuum compartment 17. In further embodiments, a vacuum container 31 may be configured to be coupled or disposed within a compartment 17, 18, 19, such as the vacuum compartment 17. A vacuum container 31 may be bound and optionally formed by an air impermeable material 33. In some embodiments, an air impermeable material 33 may form or be coupled to one or more walls 13, 14, 15, 16, of the device 100 thereby allowing the air impermeable material 33 in or coupled to the walls 13, 14, 15, 16, to form and bound all or portions of the vacuum container 31. In other embodiments, an air impermeable material 33 may be positioned proximate to the one or more walls 13, 14, 15, 16, to form and bound the vacuum container 31 while all or portions of the air impermeable material 33 may be moved towards and away from one or more walls 13, 14, 15, 16.

In some embodiments, an air impermeable material 33 may be made from any generally flexible polymer material through which air cannot pass through such as flexible nylon, polyurethane, vinyl, High-density polyethylene (HDPE), other types of polyethylene, polyvinyl chloride, Low-density polyethylene (LDPE), High-density polyethylene (HDPE), Polypropylene (PP), Polyvinyl chloride (PVC), Polystyrene (PS), Nylon, such as nylon 6 and nylon 6,6, Teflon (Polytetrafluoroethylene), Thermoplastic polyurethanes (TPU), rubber, silicone, natural or synthetic rubber, or any other suitable flexible material. In further embodiments, an air impermeable material 33 may be made from any generally rigid polymer material through which air cannot pass through such as various types of hard plastics, metal and metal alloys, or any other suitable materials that are substantially rigid. In other embodiments, an air impermeable material 33 may be made from any generally rigid material through which air cannot pass through such as various types of hard plastics, metal and metal alloys, or any other suitable materials that are substantially rigid.

The device 100 may comprise one or more vacuum cavity fasteners 34 which may govern access to the vacuum container 31 by being movable between a closed position and an open position. When a vacuum cavity fastener 34 is in an open position, objects and air may be moved into and out of the vacuum container 31. Conversely, when a vacuum cavity fastener 34 is in a closed position, air may not enter into the vacuum container 31 and objects may not be moved into and out of the vacuum container 31. In some embodiments, a vacuum cavity fastener 34 may comprise an air tight zipper, a press fit seal, such as a tongue and groove fastener, or any other air tight sealing method which may be moved between an open position and a closed position. In further embodiments, the device 100 may optionally comprise a lid which may be movably coupled to one or more walls 13, 14, 15, 16, and to a vacuum cavity fastener 34, and the lid may be opened or closed as governed by the vacuum cavity fastener 34 to allow or prevent access to the vacuum container 31.

The device 100 may comprise one or more vacuum pumps 51 which may be in communication with the vacuum container 31. A vacuum pump 51 may be operable to pump air out of and/or into the vacuum storage cavity 32 of a vacuum container 31. When a vacuum cavity fastener 34 governing access to the vacuum container 31 is in a closed position, a vacuum pump 51 may be operable to pump air out of the vacuum storage cavity 32 which may decrease the size of the vacuum container 31. Decreasing the size of the vacuum container 31 optionally may result in a decrease of the size of the body 11 and/or the size of one or more objects in the vacuum container 31.

In some embodiments, a vacuum pump 51 and the vacuum storage cavity 32 of a vacuum container 31 may be in communication via an air conduit 24. An air conduit 24 may comprise any type of channel, conduit, opening, or the like, which may be suitable for allowing air to pass from one end of the air conduit 24 to the other end. In preferred embodiments, an air conduit 24 may comprise a length of flexible tubing, such silicone tubing, latex or other rubber tubing, and flexible polymer tubing, such as vinyl, PTFE tubing, PFA tubing, FEP tubing, PDVF tubing, ETFE tubing, ECTFE tubing, THV tubing, or any other flexible material tubing. In further embodiments, an air conduit 24 may comprise a length of generally rigid tubing, such a PVC tubing, polycarbonate tubing, other polymer tubing, aluminum tubing, other metal tubing, or any other generally rigid tubing. In other embodiments, an air conduit 24 may be integrally formed with a vacuum pump 51 and/or a vacuum container 31.

In some embodiments, the device 100 may comprise a check valve 35 which may ensure that air only flows in only one direction through the air conduit 24. Preferably, a check valve 35 may be configured to prevent air from flowing through the air conduit 24 into the vacuum storage cavity 32. A check valve 35 may comprise any type of check valve, such as a ball check valve, diaphragm check valve, swing check valve or tilting disc check valve, stop-check valve, lift-check valve, in-line check valve, duckbill valve, pneumatic non-return valve, or the like.

In some embodiments, a vacuum pump 51 may be a hand operated, foot operated, or otherwise operable by a user. For example, a vacuum pump 51 may comprise a handle coupled to a shaft housing a piston, and by moving the handle relative to the body 11, a user may operate the piston to pump air out of the vacuum container 31. In another example, a vacuum pump 51 may comprise a foot pedal housing a piston, and by moving the foot pedal relative to the body 11, a user may operate the piston to pump air out of and/or into the vacuum container 31.

In other embodiments, a vacuum pump 51 may be electrically operated and may comprise a positive displacement pump such as a rotary vane pump, a diaphragm pump, a liquid ring pump, a piston pump, a scroll pump, a screw pump, a Wankel pump, an external vane pump, a roots blower or booster pump, a multistage roots pump, a Toepler pump, a lobe pump, or any other suitable positive displacement pump. In further alternative embodiments, a vacuum pump 51 may comprise a momentum transfer pump, a regenerative pump, an entrapment pump, or any other type of pump which may be suitable for motivating air out of and/or into a vacuum container 31.

In some embodiments, the device 100 may comprise one or more compartments, such as a vacuum compartment 17, a first storage compartment 18, and a second storage compartment 19, which may be configured is any size and shape in order to store one or more items. For example, a compartment 17, 18, 19, may comprise a pocket, pouch, container, or the like into which a user may store their keys, cell phone, or other objects. In further embodiments, a compartment 17, 18, 19, may be governed by one or more compartment fasteners, such as a vacuum compartment fastener 27, a first compartment fastener 28, and a second compartment fastener 29. A compartment fastener 27, 28, 29, may include any type of fastener or fastening method, such as a zipper, snap closure, magnetic closure, or any other type of fastener, which may allow or prevent objects from being inserted into and removed from a compartment 17, 18, 19.

As perhaps best shown in FIGS. 5, 6, 9, and 10, in preferred embodiments, the device 100 may comprise a body 11 having a base 12, first wall 13, and second wall 14, and the first wall 13 and second wall 14 may be coupled to the base 12 to form a vacuum compartment 17 that is bounded by the base 12, first wall 13, and second wall 14. A vacuum compartment fastener 27 may be configured to govern access to the vacuum compartment 17 by removably coupling portions of the first wall 13 and second wall 14 together. In further preferred embodiments, a vacuum container 31 may be disposed, and more preferably removably positioned, within the vacuum compartment 17. The vacuum compartment 17 may be configured in any shape and size to allow a vacuum container 31 and any objects received in its vacuum storage cavity 32 to be placed in or otherwise received in the vacuum compartment 17. Optionally, one or more auxiliary storage receptacles 21, preferably secured by one or more auxiliary receptacle fasteners 25, may be coupled to one or more walls 13, 14, 15, 16, and used to store objects. Example auxiliary storage receptacles 21 and/or auxiliary receptacle fasteners 25 may include pockets, zippered pockets, hook and loop fastener pockets, pen holding pockets, etc., and optionally be disposed within one or more compartments 17, 18, 19.

Figure 6:
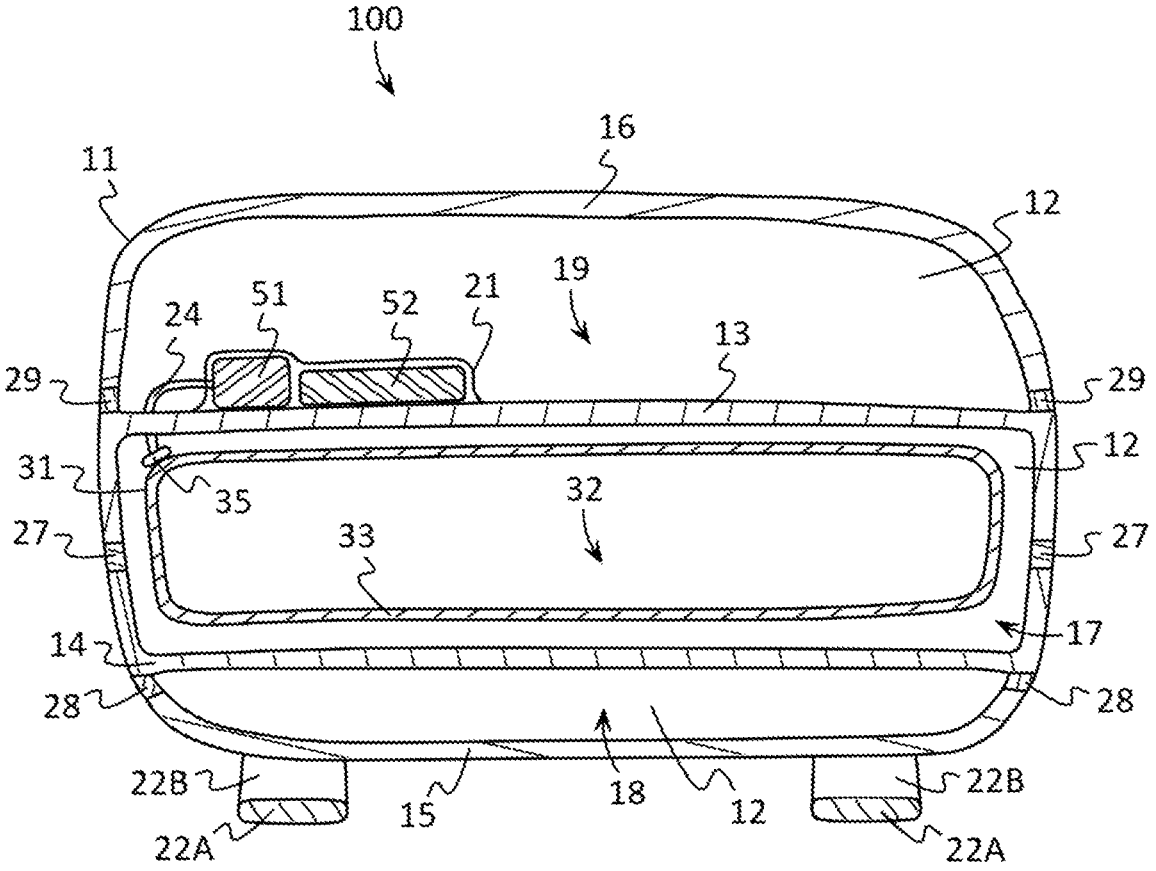
FIG. 6 shows a sectional, through line 6-6 shown in FIG. 3, elevation view of an example of a vacuum assisted storage device according to various embodiments described herein.
Figure 7:
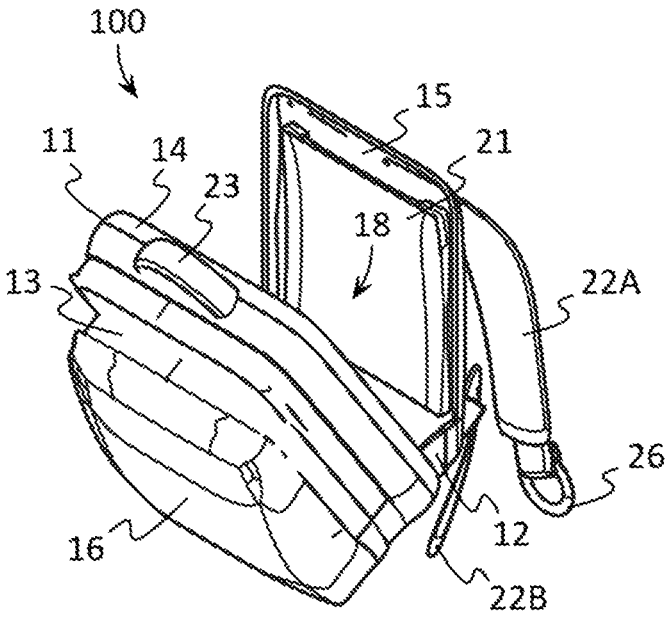
FIG. 7 depicts a top perspective view of an example of a vacuum assisted storage device opened to show an example of a first storage compartment according to various embodiments described herein.
Figure 8:
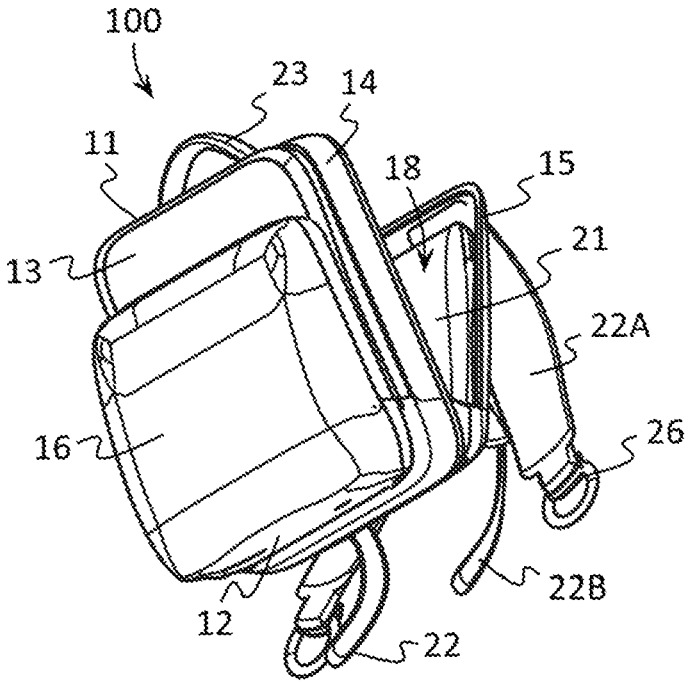
FIG. 8 illustrates a bottom perspective view of an example of a vacuum assisted storage device opened to show an example of a first storage compartment according to various embodiments described herein.
Figure 9:
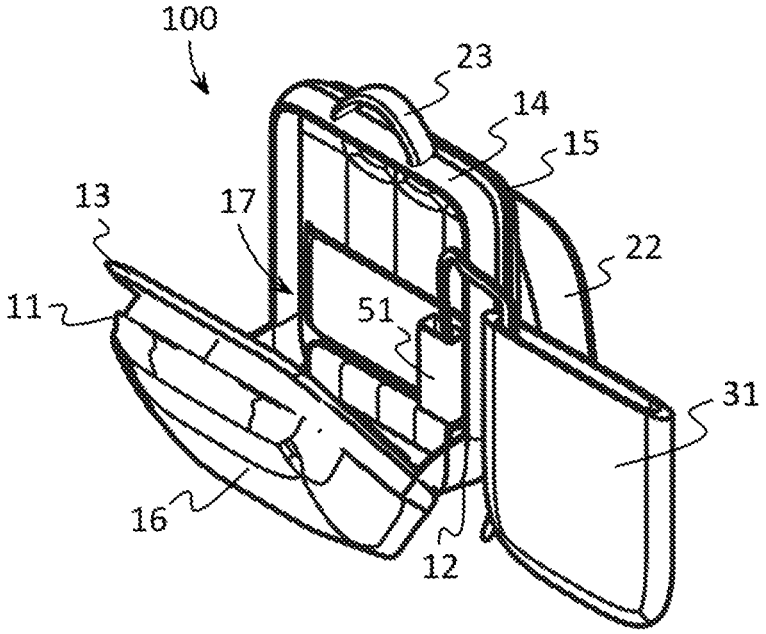
FIG. 9 shows a top perspective view of an example of a vacuum assisted storage device opened to show an example vacuum compartment and vacuum container according to various embodiments described herein.

Referring to FIGS. 6, 7, and 8, in some embodiments, the device 100 may comprise a body 11 having a third wall 15 that may be coupled to the base 12 to form a first storage compartment 18 that is bounded by the base 12, second wall 14, and third wall 15. A first compartment fastener 28 may be configured to govern access to the first storage compartment 18 by removably coupling portions of the second wall 14 and third wall 15 together. Optionally, a vacuum container 31 may be disposed, and more preferably removably positioned, within the first storage compartment 18. The first storage compartment 18 may be configured in any shape and size to allow objects, such as laptop computers, tablet computers, books, and other objects, to be placed in or otherwise received in the first storage compartment 18. Optionally, one or more auxiliary storage receptacles 21, such as pockets, zippered pockets, hook and loop fastener pockets, pen holding pockets, etc., may be disposed within the first storage compartment 18, such as by being coupled to the second wall 14 and/or third wall 15.

Figure 10:
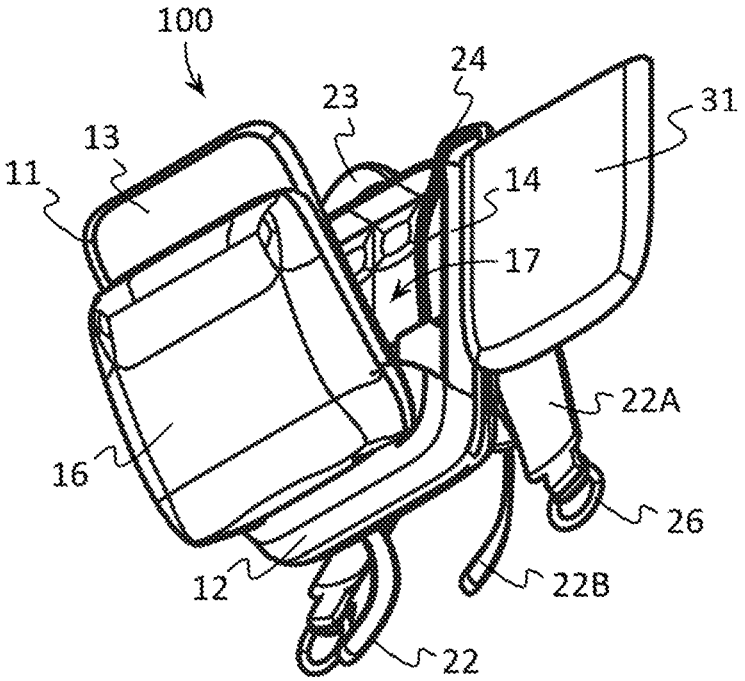
FIG. 10 depicts a bottom perspective view of an example of a vacuum assisted storage device opened to show an example vacuum compartment and vacuum container according to various embodiments described herein.
Figure 11:
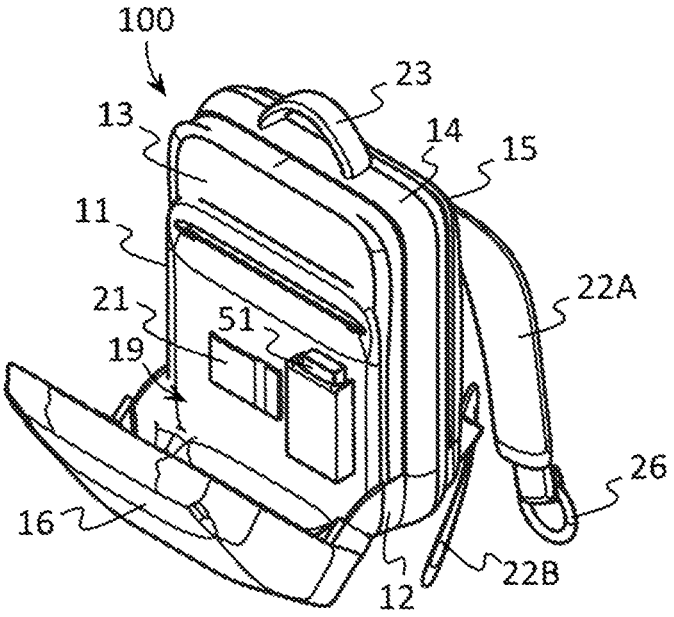
FIG. 11 illustrates a top perspective view of an example of a vacuum assisted storage device opened to show an example of a second storage compartment according to various embodiments described herein.
Figure 12:
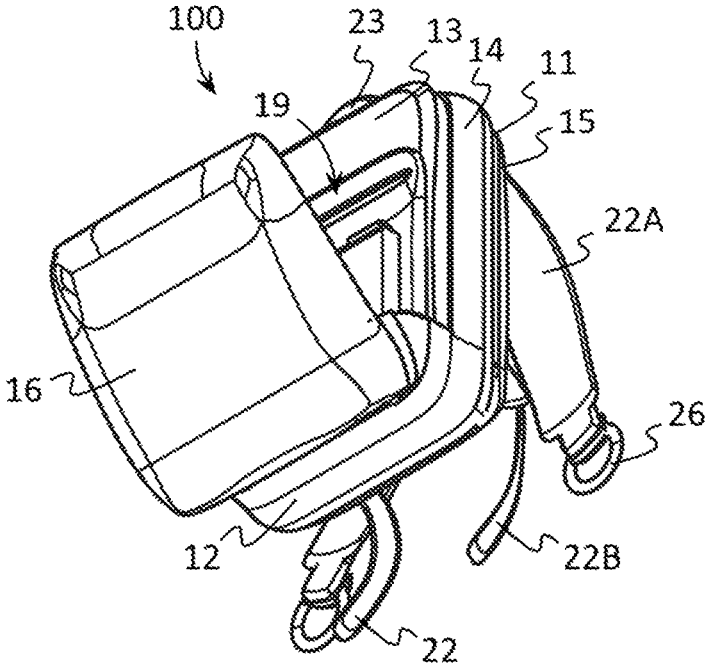
FIG. 12 shows a bottom perspective view of an example of a vacuum assisted storage device opened to show an example of a second storage compartment according to various embodiments described herein.
Figure 13:
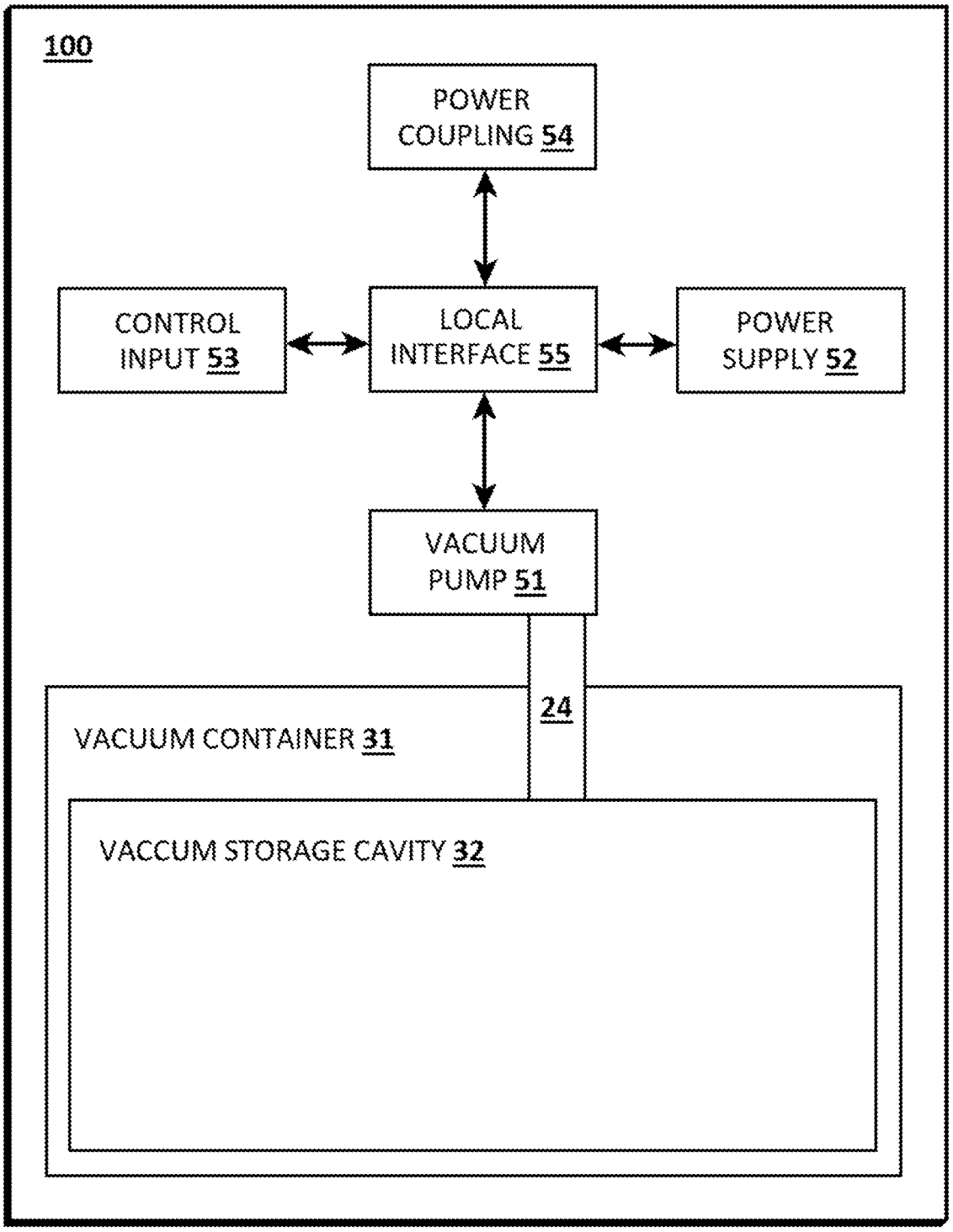
FIG. 13 depicts a block diagram of an example of a vacuum assisted storage device according to various embodiments described herein.

Turning now to FIGS. 6, 10, and 11, in some embodiments, the device 100 may comprise a body 11 having a fourth wall 16 that may be coupled to the base 12 to form a second storage compartment 19 that is bounded by the base 12, first wall 13, and fourth wall 16. A second compartment fastener 29 may be configured to govern access to the second storage compartment 19 by removably coupling portions of the first wall 13 and fourth wall 16 together. Optionally, a vacuum container 31 may be disposed, and more preferably removably positioned, within the second storage compartment 19. The second storage compartment 19 may be configured in any shape and size to allow objects, such as charging cords, cellphones, and other objects, to be placed in or otherwise received in the first storage compartment 18. Optionally, one or more auxiliary storage receptacles 21, such as pockets, zippered pockets, hook and loop fastener pockets, pen holding pockets, etc., may be disposed within the second storage compartment 19, such as by being coupled to the first wall 13 and/or fourth wall 16. In preferred embodiments, a vacuum pump 51, power source 52, and/or other elements of the device 100 may be positioned within a second storage compartment 19, while in other embodiments, a vacuum pump 51, power supply 52, and/or other elements of the device 100 may be positioned within a vacuum compartment 17 and/or first storage compartment 18.

In preferred embodiments, the device 100 may comprise one or more shoulder straps 22, sometimes called transportation conveyances, which may facilitate the ability of a user to carry or otherwise transport the device 100 and which may be coupled anywhere on the body 11. In some embodiments, a shoulder strap 22 may be used to carry the device 100 by hand and/or to carry the device 100 on or over the shoulder of a user. A shoulder strap 22 may include an upper strap 22A that may be movably and/or removably coupled to a lower strap 22B. Generally, an upper strap 22A may be coupled to upper portions of the body 11 while a lower strap 22B may be coupled to lower portions of the body 11 such as to or proximate to the base 12. An upper strap 22A and a lower strap 22B of a shoulder strap 22 may be made from synthetic materials and fibers such as nylon webbing, polypropylene webbing, polyester webbing, neoprene foam rubber, polyester fabrics, rayon fabrics, and from natural materials and fibers such as cotton webbing, flax webbing, other fabrics, such as flax, coir, cotton, hemp, jute, leather, linen, ramie, wool, silk or any other type of natural or synthetic fibers or materials including combinations of materials. Optionally, the device 100 may comprise one or more strap adjusting apparatuses 26, such as side release buckles, buckles, clasps, slides, loops, reducers, cam buckles, strap adjusters, snap hooks, D rings, tri-loops, footman loops, keepers, cord locks, strap locks, or any other suitable means for adjusting the positions at which an upper strap 22A and a lower strap 22B may be coupled together thereby adjusting the length of the shoulder strap 22.

In further preferred embodiments, the device 100 may comprise one or more handles 23, sometimes called transportation conveyances, which may facilitate the ability of a user to carry or otherwise transport the device 100 and which may be coupled anywhere on the body 11. In some embodiments, a handle 23 may be used to carry the device 100 by hand and/or to carry the device 100 on or over the shoulder of a user. Generally, a handle 23 may be coupled to upper portions of the body 11.

In further embodiments, a transportation conveyance may be configured to support the body 11 above a ground surface while reducing the friction between the body 11 and the ground surface. A friction reducing transportation conveyance may comprise a wheel, a caster, a tread or track, a low friction pad or bumper, a low friction plate, a ski, a pontoon, or any other suitable device configured to reduce the friction between the device 100 and the surface over which it is desired to be moved.

In some embodiments, the device 100 may comprise a power supply 52 which may provide electrical power to any component of the device 100 that may require electrical power. A power supply 52 may comprise a battery, such as a lithium ion battery, nickel cadmium battery, alkaline battery, or any other suitable type of battery, a fuel cell, a capacitor, a super capacitor, or any other type of energy storing and/or electricity releasing device. In further embodiments, a power supply 52 may comprise a power cord, kinetic or piezo electric battery charging device, a solar cell or photovoltaic cell, and/or inductive charging or wireless power receiver.

In some embodiments, the device 100 may comprise one or more control inputs 53 that a user may interact with such as turnable control knobs, depressible button type switches, a key pad, slide type switches, rocker type switches, or any other suitable input that may be used to modulate electricity to any component of the device 100. For example, a control input 53 may be configured to control one or more functions of the device 100 such as to operate an electrically operated vacuum pump 51 which may remove air from the vacuum storage cavity 32 of a vacuum container 31.

In some embodiments, the device 100 may comprise one or more power couplings 54 which may be removably coupled to electrical devices and which may be configured to output electrical power from the power supply 52 to a coupled to electrical device. For example, a user may connect a power coupling 54 to an electrical device, such as a cell phone, tablet computer, laptop computer, music player, etc., and power from the power supply 52 may be communicated to the electrical device via the power coupling 54. In further embodiments, the device 100 may comprise one or more power couplings 54 which may be configured to receive power input from a coupled to electrical device that may be provided to the power supply 52. For example, a user may connect a power coupling 54 to an electrical device, such as a charging station, power transformer, electrical outlet, etc., and power from the electrical device may be communicated to the power supply 52 via the power coupling 54 to recharge the power supply 52.

In preferred embodiments, a power coupling 54 may comprise a USB connector such as a female micro-USB or female mini-USB. In other embodiments, a power coupling 54 may comprise a male or female Type A USB plug, a Type B USB plug, a Mini-A USB plug, a Mini-B USB plug, a Micro-A USB plug, a Micro-B USB plug, a Micro-B USB 3.0 plug, a ExtMicro USB plug, a Lightning plug, a 30-pin dock connector, a Pop-Port connector, a Thunderbolt plug, a Firewire plug, a Portable Digital Media Interface (PDMI) plug, a coaxial power connector plug, a barrel connector plug, a concentric barrel connector plug, a tip connector plug, or any other plug, connector, or receptacle capable of enabling electrical communication.

In some embodiments, the device 100 may comprise a local interface 55, such as a circuit board, which may be used to communicatively couple one or more elements of the device 100, such as a vacuum pump 51, power supply 52, control input 53, and power coupling 54. In preferred embodiments, a local interface 55 may be an integrated circuit (IC) that integrates one or more components on a single chip sometimes called a system on a chip (SoC) or system on chip (SOC). In further preferred embodiments, a local interface 55 may be a microcontroller (or MCU, short for microcontroller unit) which may be a small computer on a single integrated circuit (SoC) containing a processor, memory, and programmable input/output interfaces or peripherals. Program memory in the form of Ferroelectric RAM, NOR flash or OTP ROM is also often included on chip, as well as a typically small amount of RAM. Microcontrollers are designed for embedded applications, in contrast to the microprocessors used in personal computers or other general-purpose applications consisting of various discrete chips. Microcontrollers are used in automatically controlled products and devices, such as automobile engine control systems, implantable medical devices, remote controls, office machines, appliances, power tools, toys and other embedded systems. By reducing the size and cost compared to a design that uses a separate microprocessor, memory, and input/output devices, microcontrollers make it economical to digitally control even more devices and processes. Mixed signal microcontrollers are common, integrating analog components needed to control non-digital electronic systems.

While some materials have been provided, in other embodiments, elements that the device 100 may comprise, such as the base 12, walls 13, 14, 15, 16, shoulder strap 22, handle 23, vacuum container 31, and/or any other element discussed herein may be made from durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A vacuum assisted backpack device, the backpack device comprising:

a body having a base, a first wall, a second wall, a third wall internal to the body, and a fourth wall internal to the body, wherein the first wall and the second wall are coupled to the base and third wall and second wall form a first storage compartment and the fourth wall and the first wall form a second storage compartment;

a vacuum compartment bounded by and located in-between the base, the first storage compartment, and the second storage compartment;

a vacuum compartment fastener configured to govern access to the vacuum compartment by removably coupling portions of the first wall to the second wall;

a vacuum container configured to be received within the vacuum compartment, the vacuum container defining a vacuum storage cavity, and the vacuum container comprising an air impermeable material;

a vacuum cavity fastener governing access to the vacuum storage cavity, the vacuum cavity fastener forming a removably air tight seal that is configured to be sealed and unsealed;

a vacuum pump positioned within the second storage compartment proximate to the base and in communication with the vacuum storage cavity, the vacuum pump operable to pump air out of the vacuum storage cavity;

an air conduit connecting the vacuum pump to the vacuum container, the air conduit passing from the second storage compartment into the vacuum compartment;

a first shoulder strap and a second shoulder strap coupled to an exterior side of the third wall so that the third wall separates the first shoulder strap and the second shoulder strap from the first storage compartment.

2. The device of claim 1, wherein the air impermeable material comprises a polymer.

3. The device of claim 1, further comprising a check valve.

4. The device of claim 1, further comprising a power supply.

5. The device of claim 4, wherein the power supply comprises a battery and the battery is positioned within the second storage compartment proximate to the base and the vacuum pump.

6. The device of claim 1, wherein the vacuum pump is operated by a control input.

7. The device of claim 1, further comprising a first compartment fastener configured to govern access to the first storage compartment by removably coupling portions of the second wall to the third wall.

8. The device of claim 7, further comprising a second compartment fastener configured to govern access to the second storage compartment by removably coupling portions of the first wall to the fourth wall.

9. The device of claim 1, further comprising a power coupling selected from one of a USB plug, a mini-USB plug, and a micro-USB plug.

10. The device of claim 9, wherein the power coupling is positioned along a side of the backpack device in-between the base and a handle.

* * * * *